United States Patent [19]

Osmera et al.

[11] 4,433,902

[45] Feb. 28, 1984

[54] PROJECTION PRINTER

[75] Inventors: Miroslav S. Osmera; Ralf M. Brooks; Sung-Soon Kim, all of Waterloo, Canada

[73] Assignee: NCR Corporation, Dayton, Ohio

[21] Appl. No.: 320,803

[22] Filed: Nov. 12, 1981

Related U.S. Application Data

[63] Continuation of Ser. No. 159,888, Jun. 16, 1980, abandoned.

[51] Int. Cl.[3] ..... B41B 13/00

[52] U.S. Cl. ..... 354/10; 354/17; 346/76 L

[58] Field of Search ..... 354/4, 10, 11, 17; 346/76 R, 76 PH, 76 L; 360/59

[56] References Cited

U.S. PATENT DOCUMENTS

| | | | |
|---|---|---|---|
| 3,176,278 | 3/1965 | Mayer | 360/59 |
| 3,273,475 | 9/1966 | Moyroud et al. | 354/10 |
| 3,314,073 | 4/1967 | Becker | 346/76 L |
| 3,351,948 | 11/1967 | Bonn | 346/76 L |
| 3,492,072 | 1/1970 | Havn, Jr. | 346/76 L |
| 3,570,380 | 3/1971 | Kamenstein | 354/11 |
| 3,613,532 | 10/1971 | Wildhaber | 354/17 |
| 3,618,487 | 11/1971 | Tietenthal et al. | 354/17 |
| 3,662,397 | 5/1972 | Ballinger | 360/59 |
| 3,703,143 | 11/1972 | Gaynor | 346/76 R |
| 3,744,611 | 7/1973 | Montanarl et al. | 346/76 PH |
| 3,985,439 | 10/1976 | Kiemle | 354/4 |
| 4,125,842 | 11/1978 | Ohnishi et al. | 346/76 L |
| 4,194,814 | 3/1980 | Fischer et al. | 346/76 L |

OTHER PUBLICATIONS

"Enhancing Ribbon Transfer Using Laser Printing" IBM Technical Disclosure Bulletin vol. 17, No. 6, Nov. 1974 p. 1807.

*Primary Examiner*—Russell E. Adams
*Attorney, Agent, or Firm*—J. T. Cavender; Wilbert Hawk, Jr.; George J. Muckenthaler

[57] ABSTRACT

A non-impact printing method wherein pulsed light is transmitted through a mask containing enlarged characters. The characters are optically reduced and are focused on a document in back of a heat-sensitive or thermal magnetic ink ribbon. Heat energy projected by the pulsed light causes ink transfer from the ribbon onto the paper.

2 Claims, 2 Drawing Figures

PROJECTION PRINTER

This application is a continuation of application Ser. No. 159,888, filed 6-16-80, now abandoned.

BACKGROUND OF THE INVENTION

In the area of providing means for transferring ink from a ribbon to record media, it is well known that impact-type printing or recording has been utilized since the earliest recording machines. The typewriter and the character printer are most common in the field of impact operation.

More recently, non-impact type apparatus has appeared in the printing and recording field and wherein the most common have been the thermal printer and the ink jet printer. When the performance of a non-impact printer is compared with that of an impact printer, one of the problems in the non-impact machine has been the control of the printing operation. As is well known, the impact operation depends on the movement of impact members such as wires or the like and which are typically moved by means of an electromechanical system which is believed to enable a more precise control of the impact members.

The advent of non-impact printing, as in the case of thermal printing, brought out the fact that the heating cycle must be controlled in a manner to obtain maximum repeated operations. Additionally, the non-impact printing operation may utilize components wherein the method is simple in operation, the transfer of ink from a ribbon to the record media is more refined or precise, and also different types of font printing can be realized.

Known methods of non-impact printing are based on ink transfer from the ribbon to the paper by means of a single component laser beam or by means of a modulated laser beam. In one instance, a focused laser beam causes the thermal transfer of ink or dye from a coated plastic ribbon to the paper. One explanation of the theory of transfer of ink provides that the laser irradiation of the substrate-ink boundary creates thermal elastic stress waves which cause the transfer of the ink or dye. Another explanation of the theory of transfer is that high density thermal energy melts and vaporizes the wax-like ink and the printing or recording is formed upon condensation of the ink or dye vapors on the lower temperature paper.

In the prior art, it is known that one of the line printers which utilizes the focused laser beam technique is designed for printing characters in a five mil density dot matrix by nineteen horizontal scans of laser beam per character.

In a number of inks being tested, there has been no indication of using a magnetic ink ribbon. It could be foreseen that a large problem in the transfer of ink containing magnetic particles is the difficulty in matching spectrosensitivity with available laser apparatus and that the cost may be prohibitive if expensive energy sources must be used.

It is therefore proposed to provide means for transferring magnetic ink from the ribbon to the paper by use of a pulsed light source and focusing the characters on the paper.

Representative prior art in the field of non-impact printing by use of thermal energy include U.S. Pat. No. 3,131,302 issued to D. G. Kimble on Apr. 28, 1964, which discloses thermoprinting by preheating the original image and front printing on heat-sensitive copy paper.

U.S. Pat. No. 3,176,278 issued to L. J. Mayer on Mar. 30, 1965, discloses a thermal method and system of magnetic recording.

U.S. Pat. No. 3,314,073 issued to C. H. Becker on Apr. 11, 1967, discloses a laser recorder with vaporizable film and including laser means focusing the laser on the coating to cause removal of bits of coating in proportion to the modulated laser thermal energy and means for moving the film past the focus point.

U.S. Pat. No. 3,351,948 issued to T. H. Bonn on Nov. 7, 1967, discloses a laser recorder using a medium having encapsulated chemicals and a source for generating a high energy beam and a low energy beam.

U.S. Pat. No. 3,570,380 issued to B. Kamenstein on Mar. 16, 1971, discloses an impactless typewriter wherein a light source is used to illuminate a thermographic material through a character-shaped aperture in a mask. The light source generates heat in the thermographic material to cause it to be transferred in the character shape to a receiving substrate.

U.S. Pat. No. 3,662,397 issued to D. O. Ballinger on May 9, 1972, discloses a thermal sensitive recording medium having reflective particles responsive to a magnetic or an electrostatic field and heat is utilized to fix a recording trace on the medium.

U.S. Pat. No. 3,703,143 issued to J. Gaynor on Nov. 21, 1972, discloses a thermal transfer sheet having a discontinuous layer of transfer material and a method of thermally transferring images.

U.S. Pat. No. 3,744,611 issued to L. Montanari et al. on July 10, 1973, discloses an electrothermic printer which has a ribbon with a thermal transferable ink coated on one surface and a coating of electrically resistive material on the other side. The ribbon is in contact with the paper while electrodes are energized to cause current to pass through a portion of the resistive material and to heat the coating of ink. The ink transfers to the paper as a dot or a line.

U.S. Pat. No. 3,985,439 issued to H. Kiemle on Oct. 12, 1976, discloses a device for light optical computer controlled drawing of masks for semiconductor components with a modulated light beam and a lens arrangement for projecting the light onto a layer of light-sensitive material disposed on a plane of a carrier to form a mask pattern. U.S. Pat. No. 4,125,842 issued to M. Ohnishi et al. on Nov. 14, 1978, discloses a method for laser recording using modulated laser light and a heat-sensitive recording material.

SUMMARY OF THE INVENTION

The present invention relates to non-impact printing and more particularly, to a printing method and apparatus wherein a heat-sensitive ribbon is caused to be transported along a path in contact with paper or like record media. A curved planar template includes masks of enlarged characters and is positioned along with optical means in curved manner to direct projection of the energy from a light source or from an array of sources onto the ribbon. Heat energy is projected through the character mask and the optical means in a manner wherein the energy strikes the thermal magnetic ink ribbon and causes transfer of the ink from the ribbon onto the paper. A single numeral or character is selected and printed one at a time by pulsing one of the array of light energy sources.

In a preferred embodiment of the invention, the template has fourteen numerals and symbols of the E13B font arranged in enlarged scale thereon so that thermal energy is dispersed over a large area to prevent damage to the template. The template and the projection optical members or reducing lenses are curved in a manner to focus and to project the energy of the light onto the ribbon for transfer of the ink onto the paper at the actual size of the characters. In the present invention the template image is reduced approximately ten times to the desired size for printing on the record paper.

In view of the above discussion, the principal object of the present invention is to provide a method for transferring magnetic ink from a ribbon onto record media.

Another object of the present invention is to provide a method of projection printing wherein heat sensitive magnetic ribbon is used as a donor of ink material.

An additional object of the present invention is to provide a character mask and an energy source for printing desired characters.

A further object of the present invention is to provide an enlarged mask of characters and an energy source along with projection optics for printing actual size characters.

Additional advantages and features of the present invention will become apparent and fully understood from a reading of the following description taken together with the annexed drawing.

DETAILED DESCRIPTION OF THE INVENTION

The projection printing of the numerals and symbols of the E13B common language font in non-impact manner, as provided by the present invention, is accomplished by light source means 12 arranged in a curved or arcuate pattern and directing light energy toward record media 14. The light source means 12 comprises a plurality of individual light energy sources 16 which may be of laser type or of infrared type with the capability for supplying sufficient thermal energy in the environment of the record media 14. While the individual light elements 16 are shown as disc or wafer shaped, the actual laser units are elongated to emit the coherent light beams. The record media 14 may be a document such as a bank check or like ink-receiving paper material.

Figure 1:
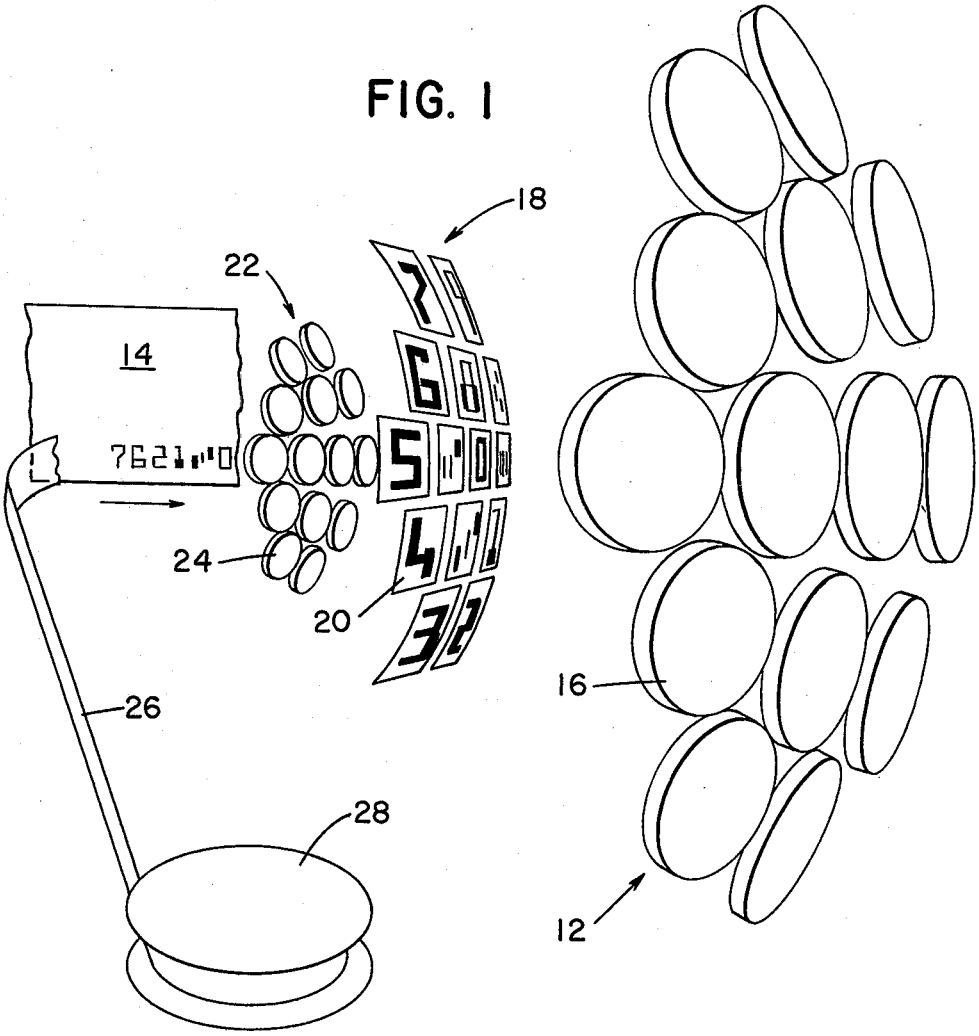
FIG. 1 is a diagrammatic view incorporating the subject matter of the present invention.
Figure 2:
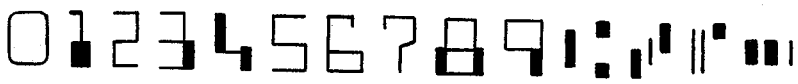
FIG. 2 illustrates the line of characters of the E13B font.

A mask arrangement 18 is disposed in like curved manner and in a plane at a location between the light source means 12 and the record media 14. The mask arrangement 18 includes a plurality of individual masks 20 disposed in a pattern coinciding with that of the light source elements 16 and having apertures therein representing the fourteen numerals and symbols of the E13B font in enlarged fashion, as shown in FIG. 2.

An optical system 22 is provided at a location between the mask arrangement 18 and the document 14. The optical system or arrangement 22 comprises a plurality of projection lenses 24 which are disposed in curved manner in a like pattern as and associated with the light elements 16 and the masks 20, and are of a magnification to reduce the image of each character from the individual masks 20 for projection onto the document 14. The optical system 22 is placed at a location wherein the projected images of the characters are focused on the back of the ribbon and on the surface of the document 14. The projected images are reduced by approximately ten times to obtain the actual size of the characters printed on the document 14.

A heat-sensitive magnetic ribbon 26 is caused to be transported from a spool 28 and along a line of printing in the direction of the arrow near the bottom of the document 14. The ribbon 26 carries thermal magnetic ink thereon and the ink is transferred to the document 14 during the non-impact printing operation. It should also be noted that the ribbon 26 is transported along with the paper document 14 at a constant speed and in contact therewith during printing operations, and additionally the document and the transported ribbon are the only moving parts of the apparatus.

In the operation of the projection printer, a single numeral is selected by pulsing one of the array of light energy sources 16 and heat energy projected by the energy source or laser element causes transfer of ink from the ribbon 26 to the document 14. The result is a full-faced character printed in serial manner on the document by use of the character masks 20 and the projection lenses 24.

It is thus seen that herein shown and described is an arrangement for projection printing of characters wherein magnetic ink is caused to be transferred from a ribbon onto a document by use of thermal energy originating from a light source and projecting through a mask of character-shaped apertures. The selection of the printing characters during operation is achieved without moving parts, except for the ribbon and the document, thus increasing the reliability of the device. The projection printing enables the accomplishment of the objects and advantages mentioned above and while a preferred embodiment of the invention has been disclosed herein, variations may occur to those skilled in the art. It is contemplated that all variations and modifications not departing from the spirit and scope of the invention hereof are to be construed in accordance with the following claims.

We claim:

1. A projection printer comprising a plurality of thermal energy light elements arranged in arcuate manner, printing paper spaced from said plurality of light elements and movable along a line of printing, a plurality of masks each associated with and disposed in like arcuate manner as each of said light elements and including an enlarged aperture representing a character to be printed, a plurality of projection lenses each associated with and positioned in like arcuate manner as each of said light elements and each of said masks to receive images of characters and to reduce said images prior to printing, and a ribbon having thermal sensitive ink material thereon and movable with said printing paper and positioned in contact therewith for transferring said ink material thereto upon pulsing of said light elements to act on said ribbon by heating said ink material in the shape of apertures in said masks for printing of characters on said printing paper.

2. Apparatus for non-impact printing on record paper movable along a line of printing, comprising a plurality of thermal energy light elements arranged in a pattern of arcuate shape, a plurality of character masks spaced from and arranged in a similar pattern as said light elements and each mask having an aperture representing a character to be printed, a plurality of projection lenses arranged in a similar pattern as each of said light elements and each of said masks to receive images of characters projected through the apertures of said masks, and a ribbon movable with said record paper and positioned in contact therewith and having heat sensitive ink thereon responsive to said light elements for transferring ink to said record paper by heating said ink in the shape of apertures in said masks when said light elements are energized to cause images of characters to be projected toward and onto said record paper.

* * * * *